United States Patent [19]

Wood

[11] 4,143,490

[45] Mar. 13, 1979

[54] LENS POLISHING APPARATUS

[76] Inventor: W. N. Wood, 4934 Santa Fe, Dallas, Tex. 75223

[21] Appl. No.: 862,943

[22] Filed: Dec. 21, 1977

[51] Int. Cl.[2] ..... B24B 13/02

[52] U.S. Cl. ..... 51/58

[58] Field of Search ..... 51/57, 58, 67, 124 L

[56] References Cited

U.S. PATENT DOCUMENTS

| | | | |
|---|---|---|---|
| 3,203,138 | 8/1965 | Ford | 51/58 |
| 3,782,042 | 1/1974 | Strasbaugh | 51/58 |

*Primary Examiner*—Harold D. Whitehead

*Attorney, Agent, or Firm*—Crisman & Moore

[57] ABSTRACT

Apparatus for polishing or grinding an optical lens through multi-directional, coplanar movement of a lens support frame relative to a polishing head. A pair of drive cams are rotated with an eccentrically mounted shaft while mounted upon orthogonal alignment braces for converting the rotation of the cam into a circular point pattern. A lens support table upstands from each cam for the support of a lens thereon in abutting relationship with a grinding or polishing head thereabove and is driven in said circular point pattern while in engagement therewith. The polishing head and cam base are likewise bidirectionally driven in orthogonal directions for permitting polishing of the entire surface area of the lens mounted thereon. In this manner lens polishing or grinding may be effected in a totally planar configuration for preventing lens slapping and edge aberration.

13 Claims, 3 Drawing Figures

LENS POLISHING APPARATUS

BACKGROUND OF THE INVENTION

The invention relates to lens grinding and polishing apparatus, and, more particularly, to a lens grinding and polishing apparatus for moving the lenses relative to the polishing head in a single plane.

It is generally the practice in the lens grinding and polishing industry to polish a plurality of lenses at one time in a manner whereby the lens is brought to engage a polishing or grinding implement moved relative thereto. Such apparatus generally includes a lens table or stand, which upstands from various mechanical linkages imparting movement thereto relative to the polishing or grinding implement. One such prior art embodiment includes a single, vertically mounted shaft which supports the aforesaid lens table. The lower portion of the shaft is arcuately driven in a circular pattern to move the lens throughout a circular path of a predefined dimensions facilitating the grinding of the total surface area thereof. The drive mechanisms for such prior art devices have often included intricate and complicated drive networks for facilitating the aforesaid multi-directional actuation through multi-axis gimbal mounts. Although gimbal mountings are relatively effective, certain problems coexist therewith.

In the grinding and polishing of relatively smaller lenses of the type used in eyeglasses and the like, the aforesaid gimbal mount, induces a slight angulation to the lens table throughout the lateral movement thereof. The slight angulation in the lens table is transferred to the lens relative to the polishing or grinding head, inducing slight edge aberrations upon the lens and related problems. One such related problem is the "slapping" of the lens against the polishing or grinding implement, oftentimes a tapered arm engaging the lens, which arm is adapted for continuous pressured engagement therewith. Whenever "slapping" occurs, a poorer quality polishing results. The "slapping," however, is inevitable with the slight angulation induced upon the lens through the gimbal mount. The degree of slapping may only be reduced by an increase in length of the table support arm, whereby the magnitude of the angulation deflection is reduced as a trigonometric function thereof.

It would be an advantage therefore, to overcome certain of the problems and inconveniences of prior art apparatus by providing an improved lens polishing and grinding apparatus which would move the lens in about a single plane relative to the polishing or grinding head. The lens-grinding apparatus of the present invention is especially adapted for use in polishing a lens through the movement of a lens support table actuated in a single plane relative to the polishing head. The coplanar actuation is effected through the eccentric drive of lens drive cams supported about orthogonal alignment arms. In this manner the operation of grinding or polishing optical lenses is facilitated without the "slapping" and/or distortion of the lens due to the prior art angulation of the support table.

SUMMARY OF THE INVENTION

The invention relates to the apparatus for grinding or polishing optical lenses in the commercial preparation thereof, which apparatus includes a lens support table upstanding from a cam eccentrically mounted about a drive shaft, with the cam supported upon orthogonal alignment arms. A first alignment arm is mounted to a second alignment arm secured in an orthogonal relationship therewith. The second alignment arm is reciprocally mounted in a support block, permitting only rectilinear motion therethrough. The first support arm is mounted to one of the eccentric cams for permitting only rectilinear motion relative thereto. In combination, the orthogonal arms convert the otherwise rotational motion of the drive shaft into circular point movements within a single plane. In this manner, the lens mounted relative thereto atop the lens table is moved in a coplanar configuration relative to a polishing head secured thereabove.

In another aspect of the invention, the polishing head is secured to a support block mounted for linear actuation relative to the lens support table. In this manner, the polishing head may be driven with rectilinear motion for movement of the polishing head across the surface of the lens to facilitate the grinding of a larger surface thereof. The support head is mounted to the lens grinding apparatus with an actuation means for remotely positioning the polishing head relative to the lens. In this manner, the polishing head may be remotely actuated relative to the lens to effect engagement and disengagement from the surface to be polished.

In yet another aspect of the invention, the cam driveshaft is mounted upon a moveable base structure including a reciprocally mounted carriage whereby the base can be moved rectilinearly relative to the polishing apparatus frame. In the present invention the carriage is moved in a direction orthogonal to that of the polishing head carriage for facilitating movement of the lens beneath the polishing head in a manner providing full surface area engagement therebetween. It may thus be seen that a second eccentrically mounted cam for support of a second lens support table may be incorporated for the grinding of a plurality of lenses simultaneously. The orthogonal alignment arms therein facilitating the coplanar grinding of the lenses permit the preparation of the optical dimensions thereof in a manner heretofore infeasible in the prior art.

BRIEF DESCRIPTION OF THE DRAWINGS

For a more complete understanding of the present invention, and for further objects and advantages thereof, reference may now be had to the following description taken in conjunction with the accompanying drawings, in which.

DETAILED DESCRIPTION

Figure 1:
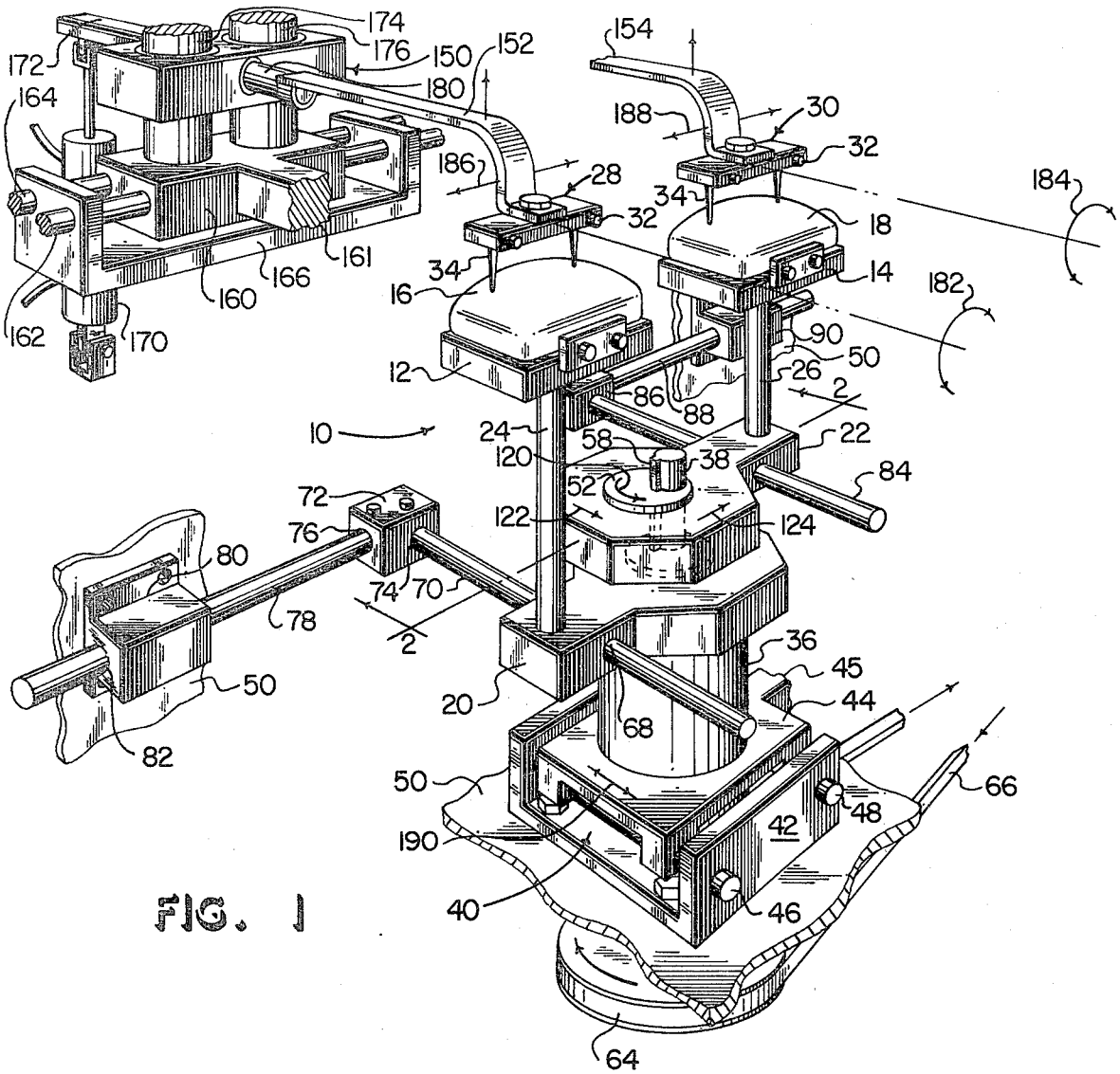
FIG. 1 is a perspective, fragmentary view of one embodiment of the lens grinding apparatus constructed in accordance with the principles of the present invention with parts thereof cut away for purposes of illustration.

Referring first to FIG. 1, there is shown a perspective view of one embodiment of a lens polishing and grinding apparatus 10, constructed in accordance with the principles of the present invention and adapted for the coplanar grinding or polishing of optical lenses. The apparatus 10 herein described includes a pair of lens support tables 12 and 14, having lenses 16 and 18, respectively, shown secured thereon. The lens support tables 12 and 14 upstand from drive cams 20 and 22, respectively, which provide the coplanar circular point movement thereof. The cam 20 supports the lens table 12 through a support rod 24 upstanding therefrom. In like manner, cam 22 supports the lens table 14 with a support rod 26 upstanding therefrom. The support rods 24 and 26 are securely mounted to the cams 20 and 22 for the support of the lenses thereupon and the grinding or polishing thereof. The lens grinding and/or polishing apparatus of the present invention is specifically adapated for movement of the lens relative to conventional polishing heads 28 and 30. The heads 28 and 30 are provided with a series of mounting screws 32 for the replacement of the particular grinding or polishing head desirable for the particular lens application. In FIG. 1, a plurality of polishing arms 34 are shown, depending from the polishing heads 28 and 30. The polishing arms 34 may be replaced with other types of conventional polishing arms and/or grinding heads secured to the aforesaid heads 28 and 30, with the screws 32. In this manner, the apparatus 10 is adaptable for both types of lens preparation.

Still referring to FIG. 1, it may be seen that the drive cams 20 and 22 are mounted upon a support base 36 having a shaft 38 extending therethrough. The support base 36 is likewise mounted upon carriage 40, including a base 42 and table 44 adapted for reciprocal rectilinear actuation thereupon. The table 44 is mounted to the base 42 through a pair of support shafts 46 and 48, extending therethrough in parallel spaced engagement. In this manner, the table 40 may be moved rectilinearly by conventional drive means (not shown) connected to the table 44 through linkage 45. In this manner, the structure upstanding thereon, including the lens support tables 12 and 14, is moved both in a circular pattern and transversely relative to the polishing heads 28 and 30.

The carriage 40 is shown to be mounted upon and secured to a system frame 50, shown in fragmentary perspective cutaway. It should be noted that the remaining elements and sections of frame 50 are in general not shown for purposes of clarity, and since such structure should be evident for the appropriate mounting of the various elements of the system 10. Such a frame or structure should be of conventional design in the art and the structural embodiment thereof is therefore not shown.

Figure 2:
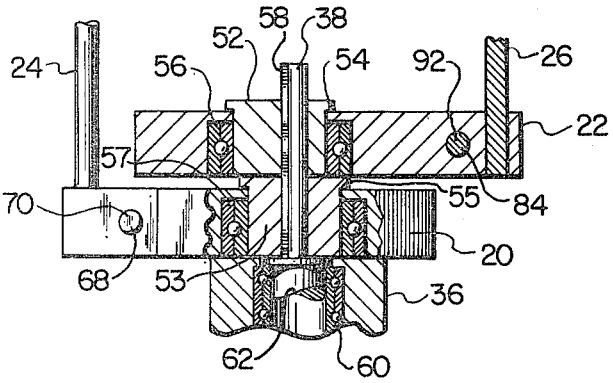
FIG. 2 is an enlarged cross sectional side elevational view of the lens drive cam of FIG. 1 taken along lines 2—2 thereof, and showing the eccentric mounting of the driveshaft therethrough.

Referring now to FIG. 2, there is shown a side elevational cross sectional view of the drive cams 20 and 22 of FIG. 1. The shaft 38 is shown upstanding from the drive cams 20 and 22 through eccentric hubs 52 and 53 secured within apertures 54 and 55 formed through said cams, respectively. Bearing races 56 and 57 are secured within the apertures 54 and 55, respectively, whereby the hubs 52 and 53 are permitted to rotate relative to said cams. The combined rotation of the hubs 52 and 53 and the shaft 38 is ensured by the positioning of a key 58 in the shaft 38, which extends into said hubs for providing the rotation thereof. In this constructional embodiment, the shaft 38 and hubs 52 and 53 rotate relative to the cams 20 and 22 inducing said cams to move in a circular, coplanar pattern. This pattern is referred to herein as a circular point pattern, since the lens support rods 24 and 26 upstand from a point upon the respective cam and move in circular patterns. The diameter of the aforesaid point pattern is determined by the degree of eccentricity of hubs 52 and 53.

Still referring to FIG. 2, it may be seen that the housing 36 depending from the cam 20, in support thereof, also includes a threaded bearing 60 centrally disposed therein for the rotatable mounting of a lower, enlarged portion 62 of shaft 38. The shaft 62 is further mounted for extension through the carriage 40 and connection to a pulley 64, shown in FIG. 1, for being driven therefrom.

Referring now to FIG. 1, the pulley 64 is shown engaging a drive belt 66 wrapped therearound, the other end of which is connected to a conventional drive motor (not shown). The pulley rotation in turn causes the shaft 62 and the upper portion 38 thereof to rotate, effecting the movement of the cams 22 and 20 therearound. The rotation of the cams 20 and 22 is prevented by the positioning of pairs of alignment arms therethrough, which are adapted for converting rotational motion into a circular point pattern, coplanar movement. It may thus be seen that cam 20 includes an elongated aperture 68, formed therethrough, for receiving a first alignment arm 70 in slidable engagement therewith. The aft end of the arm 70 is connected to a mounting elbow 72 in secured engagement therewith. The mounting elbow 72 includes an aperture 74 formed therein for receiving the arm 70 in an orthogonal relationship with an aperture 76 formed therethrough for receiving a second alignment arm 78 therein. In this manner, alignment arms 70 and 78 are presented in orthogonal, or right angle, interengagement, therein facilitating bidirectional rectiliner movement within a single plane. The alignment arm 78 is mounted within a slide brace 80, secured to the frame 50 and constructed with an aperture 82 therethrough for receiving the arm 78 therein in slidable engagement therewith. In like manner, the cam 22 includes first alignment arm 84 secured to a mounting elbow 86, having a second alignment arm 88 securely affixed thereto in orthogonal relationship therewith. A second slide brace 90 is therein provided for receiving the alignment arm 88 therethrough and is likewise secured to the frame 50.

Figure 3:
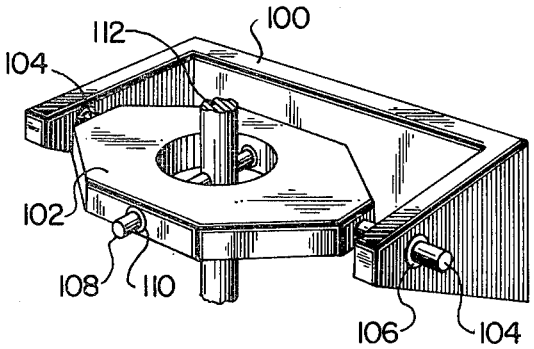
FIG. 3 (PRIOR ART)
FIG. 3 is a perspective view of a prior art lens mounting shaft illustrating the conventional gimbal mount thereof.

Referring now to FIG. 3, there is shown on prior art mounting for the lens support table of the conventional design discussed above. A mounting brace 100 supports a pivot carriage 102, mounted to the brace 100 upon a shaft 104 secured within bearings 106 provided therein. The shaft 104 is securely affixed to the carriage 102 in orthogonal relationship with a second shaft 108, extending through said carriage. The shaft 108 is mounted within bearings 110 secured within the carriage 102 for permitting the smooth rotational relationship therebetween. A lens support shaft 112 is shown mounted to the shaft 108 for pivotal rotation therewith relative to the carriage 102. It may be seen that the shaft 112 may be rotated in any direction relative to the brace 100 while supporting a lens table 12, as shown in FIG. 1. It may be seen however, that the aforesaid gimbal amount of the support shaft 112 would cause a slight angular offset from the horizontal plane which the lens table 12 would normally assume. Such an angular offset is not shown because it is trigonometrically calculable for any particular angular movement of a shaft 112 of known length.

Referring again to FIG. 1, there is shown the assembled lens polishing apparatus 10 of the present invention with the shaft 38 having the key 58 facing the support rod 24. For purposes of illustration, the hub 52 will be said to rotate an incremental distance in the direction of the arrow 120, shown thereon. Such an increment of rotation would be induced by a counterclockwise rotation of the shaft 38. As shown in FIG. 1, such a rotation would induce the cam 22 to move in the direction of the arrow 122, drawn on the upper face thereof. The arrow 122 illustrates the movement of the cam 22 along the alignment arm 84. Further rotation of the shaft 38 will induce movement of the cam 22 in the direction of the arrow 122 and in the direction of an arrow 124 drawn on the face thereof. The lateral movement of the cam 22 in the direction of the arrow 124 is facilitated through the movement of the second alignment arm 88 relative to the securing block 90. It may thus be seen that as shaft 38 rotates movement of the cam 22 in a circular point pattern is induced and the alignment arms 84 and 88 slide within said cam and the slide block 90 as discussed above. This movement is linear due to the orthogonal alignment of said apertures in said blocks. In this manner the lens pad 14 may be seen to rotate in a circular, coplanar point pattern which is the sum of the bidirectional rotational movements induced from the eccentric hub 52. An equivalent result is imported from the underlying cam 20 and lens pad 12 upstanding thereon.

The movement of the cams 20 and 22 permit a pattern of coplanar lens movement relative to the polishing heads 28 and 30. However, the movement is sufficient to cover but a small portion of the lens 16 and 18. Therefore, without expanding the rotational parameters of the cams 20 and 22, the carriage 40 is constructed with means for inducing the rectilinear movement of the table 44 relative to the base 42 upon the shafts 46 and 48. This movement is effected through a conventional drive train, now shown, but connected to the carriage 40 through linkage 45 in a conventional fashion. Preferably, the movement rate of the carriage 40 is much less than that of the speed of rotation of the shaft 38 for obvious reasons. The movement of the carriage 40, however, may be seen to facilitate a greater lateral area of surface engagement between the respective lenses 16 and 18 and polishing heads 28 and 30. To facilitate an enlarged longitudinal pattern of surface engagement between said lenses and said polishing heads, the polishing heads are supported from a carriage 150 mounted to the frame 50 in a conventional manner not shown. The carriage 150 includes a cantilever arm 152, extending outwardly therefrom for the support of the polishing head 28 on the end thereof. In like manner, a cantilever arm 154 is shown in fragmentary view in support of the polishing head 30. The respective carriage for said polishing head 154 is not shown for purposes of clarity, although it may be mounted adjacent thereto and/or to the same carriage 150, as is suitable in conventional designs. The carriage 150 further includes a lower carriage 160, adapted for movement upon shafts 162 and 164 mounted within a support frame 166. In this manner, the lower carriage 160 is permitted to move in a rectilinear fashion, preferably, orthogonal to that of the movement of the carriage 40, for facilitating the longitudinal positioning of the respective polishing head 28 and/or 30. The movement of the lower carriage 160 is preferably facilitated in a manner similar to that of the carriage 40, whereby a drive train (not shown) moves the respective carriages through a linkage 161 at a rate substantially less than the rate of rotation of the shaft 38.

The carriage 150 further includes a means for vertically positioning the respective polishing heads 28 and 30 relative to the lenses 16 and 18. There is diagrammatically shown a cylinder 170 of the type adaptable for positioning the carriage 150 via a frame member 172 extending rearwardly therefrom and in engagement therewith. The carriage 150 is vertically reciprocated relative to the lower carriage 160 via a pair of alignment shafts 174 and 176 upstanding therefrom and extending through the upper carriage 150 in a conventional slidable engaging relationship therewith.

It may be seen from the illustration of FIG. 1 that various elements of the drive train as well as the frame members are eliminated for purposes of clarity. The eliminated elements are conventional elements of practical machine design and are readily ascertainable by men skilled in the art. For this reason, the base of the cylinder 170 is not shown to be connected nor the manner of operation thereof illustrated to any degree of specificity, even though various manners of design are possible. Various ones of such structural embodiments are conventional in the art. For example, the polishing heads 28 and 30 are typically rotatably mounted within the appropriate support frame shown herein as upper carriage 150. The cantilever arm 152 is therefore shown to be connected to the upper carriage 150 through a rotatable support shaft 180, extending outwardly therefrom. The angular actuation of said polishing heads 28 and 30 may be seen by the arrows 182 and 184 disposed forwardly thereof. In like manner, the arrows 186 and 188 illustrate the bidirectional linear movement of the said polishing heads induced from the actuation of the lower carriage 160. In like manner, a double ended arrow 190 is shown upon the carriage 40 for illustration of bidirectional, rectilinear movement thereof induced by the drive train (not shown), discussed above.

In operation, the respective lenses 16 and 18 are placed upon the support tables 12 and 14 in a conventional manner and secured thereto in a conventional fashion. The respective polishing heads 28 and 30 are provided with the appropriate polishing members as grinding elements for the preparation of said lenses in the desired optical configuration. The vertical positioning of the polishing heads 28 and 30 is provided through actuation of the cylinder 170, preferably of the pneumatic variety, moving the upper carriage 150 relative to the lower carriage 160. The drive shaft 38 is rotated by the pulley 64 which rotates said shaft with the upper hub 52 and the lower hub 53 in the cams 22 and 20, respectively. Rotation of the hubs therein induces the cams to move about the orthogonal alignment arms with the resultant planar, circular movement of the lens support pads 12 and 14 thereabove. In this manner, the subject lenses 16 and 18 are prepared with the requisite optical configuration without the "slapping" and edge abberation typical of prior art structures of the type shown in FIG. 3.

It is believed that the operation and construction of the above described invention will be apparent from the foregoing description. While the invention and the constructural embodiments shown described have been characterized as being preferred, it will be obvious that various changes and modifications may be made without departing from the spirit and scope of the invention as defined in the following claims:

What is claimed is:

1. Apparatus for the coplanar movement of optical lenses for the grinding and polishing thereof relative to a polishing head disposed adjacent thereto in engagement therewith, said apparatus comprising:

a lens support frame for receiving and securely retaining an optical lens placed thereon;

a drive cam disposed beneath said lens support frame in structural engagement therewith for moving said support frame in a circular, coplanar point pattern;

a driveshaft upstanding in interengagement with an intermediate portion of said cam;

a cam hub having an aperture formed therethrough in eccentric alignment therewith for receiving said shaft therein and said cam therearound and facilitating the circular point pattern movement of said cam in conjunction with the rotation of said shaft;

first and second alignment arms coupled to said cam in slidable interengagement therewith for facilitating a circular point pattern movement of said cam about said shaft relative to the rotation thereof;

means for rotating said shaft to impart circular point pattern movement to said cam and the resultant circular movement of said lens support frame upstanding thereon; and a structural support frame having said drive cam and alignment arms mounted relative thereto for the support thereof.

2. The apparatus set forth in claim 1 and including means for translating said cam in a generally horizontal plane during the circular movement thereof for the translation of the lens support frame thereabove.

3. The apparatus as set forth in claim 2 wherein said means for driving said cam transversely includes a support carriage mounted for reciprocal movement upon said support frame and including a pair of support shafts and spaced parallel engagement thereupon.

4. The apparatus set forth in claim 1 wherein said alignment arms are provided in an orthogonal configuration wherein said first alignment arm is slidably coupled to said cam and said second alignment arm is slidably mounted to said support frame.

5. The apparatus as set forth in claim 1 and further including said polishing head being mounted relative to said lens support frame and including a support carriage slidably mounted upon said support frame for transverse rectilinear motion relative thereto for imparting lateral reciprocal movement to said polishing head.

6. The apparatus as set forth in claim 5 wherein said polishing head support carriage includes means for remotely positioning said carriage relative to said lens.

7. The apparatus as set forth in claim 1 wherein a pair of drive cams are provided one atop the other in support of a pair of lens support frames for the grinding of a pair of optical lenses simultaneously thereupon.

8. The apparatus as set forth in claim 1 wherein said drive means includes a pulley attached to said shaft extending through said cams and driven by a belt drive secured thereto.

9. Apparatus for the coplanar grinding and polishing of optical lenses by the movement of a lens support table relative to a grinding head disposed adjacent thereto, said apparatus comprising:

a support frame for housing and supporting said grinding head relative to said lens support table for facilitating the select movement therebetween;

a drive cam supported upon said support frame for circular movement relative thereto;

drive means coupled to said cam for the rotational drive thereof;

a hub disposed within said cam with drive means coupled thereto in eccentric interengagement therewith for transducing the rotational movement of said drive means into a circular point pattern movement of said cam;

means for supporting said lens support table from said cam; and first and second alignment arms secured in orthogonal interengagement therebetween, said first alignment arm being coupled to said cam for permitting bidirectional rectilinear motion thereupon and said second alignment arm being reciprocally mounted to said support frame for permitting bidirectional rectilinear movement relative thereto and in a directional orthogonal to that of said first alignment arm, wherein said lens support table is moved in a circular point pattern within a single plane relative to said grinding head.

10. The apparatus as set forth in claim 9 wherein said polishing head is secured to a polishing head carriage adapted for both transverse reciprocal movement and vertical actuation relative to said lens support table.

11. The apparatus as set forth in claim 9 wherein said drive cam is mounted upon a support carriage, said support carriage being adapted for transverse, reciprocal movement

12. The apparatus as set forth in claim 11 wherein the movement of said cam support carriage is orthogonal to that of said grinding head support carriage movement.

13. The apparatus as set forth in claim 10 wherein said first and second alignment arms include first and second cylindrical rods adapted for sliding interengagement with mating connecting members and wherein said drive cam is constructed with an aperture formed therethrough for receiving said first alignment arm therein, and said support frame includes a slide block secured thereto, having an aperture formed therethrough for receiving said second alignment arm in slidable engagement therein.

* * * * *